US008802610B2

(12) United States Patent
Kumagai et al.

(10) Patent No.: US 8,802,610 B2
(45) Date of Patent: Aug. 12, 2014

(54) CLEANING LIQUID AND ANTICORROSIVE AGENT COMPRISING A MERCAPTO COMPOUND AND SOLVENT

(71) Applicant: Tokyo Ohka Kogyo Co., Ltd., Kawasaki (JP)

(72) Inventors: Tomoya Kumagai, Kawasaki (JP); Takuya Ohhashi, Kawasaki (JP); Takahiro Eto, Kawasaki (JP); Daijiro Mori, Kawasaki (JP); Takayuki Haraguchi, Kawasaki (JP)

(73) Assignee: Tokyo Ohka Kogyo Co., Ltd., Kawasaki-Shi (JP)

( * ) Notice: Subject to any disclaimer, the term of this patent is extended or adjusted under 35 U.S.C. 154(b) by 0 days.

(21) Appl. No.: 14/021,505

(22) Filed: Sep. 9, 2013

(65) Prior Publication Data

US 2014/0018281 A1 Jan. 16, 2014

Related U.S. Application Data

(62) Division of application No. 13/728,728, filed on Dec. 27, 2012, now abandoned.

(30) Foreign Application Priority Data

Dec. 28, 2011 (JP) ..... 2011-288930
Dec. 28, 2011 (JP) ..... 2011-288931

(51) Int. Cl.
*C11D 7/34* (2006.01)

(52) U.S. Cl.
USPC ..... 510/175; 510/245; 510/248; 510/254; 510/261; 510/401; 510/402; 510/432; 134/1.2; 134/1.3; 134/22.19

(58) Field of Classification Search
USPC ..... 510/175, 245, 248, 254, 261, 401, 402, 510/432; 134/1.2, 1.3, 22.19
See application file for complete search history.

(56) References Cited

U.S. PATENT DOCUMENTS

| | | | | |
|---|---|---|---|---|
| 2002/0107151 | A1 | 8/2002 | Ahn et al. | |
| 2005/0048397 | A1 * | 3/2005 | Jo et al. | 430/256 |
| 2006/0180789 | A1 * | 8/2006 | Jones et al. | 252/180 |
| 2007/0272275 | A1 * | 11/2007 | Wu et al. | 134/19 |
| 2009/0118153 | A1 * | 5/2009 | Rath et al. | 510/176 |

FOREIGN PATENT DOCUMENTS

JP 2000-273663 A 10/2000

* cited by examiner

*Primary Examiner* — Charles Boyer
(74) *Attorney, Agent, or Firm* — Knobbe Martens Olson & Bear LLP

(57) ABSTRACT

A method of cleaning a substrate having a metal layer including copper or a copper-containing alloy, the method including cleaning the substrate using a cleaning liquid that includes a mercapto compound represented by one or both of the following formulas (1) and (2), and a solvent containing water and a water-soluble organic solvent:

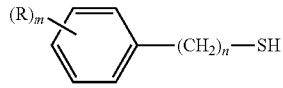

(1)

in which R represents a substituent group; m is an integer of 1 to 3; and n is an integer of 0 to 3, when m is 2 or 3, R may be the same or different;

$$HS—(CH_2)_x—OH \quad (2),$$

in which x is an integer of no less than 3.

5 Claims, No Drawings

CLEANING LIQUID AND ANTICORROSIVE AGENT COMPRISING A MERCAPTO COMPOUND AND SOLVENT

RELATED APPLICATIONS

This application is a divisional of U.S. patent application Ser. No. 13/728,728, filed on Dec. 27, 2012, which claims priority to Japanese Patent Application Nos. 2011-288930 and 2011-288931, both filed Dec. 28, 2011, the entire contents of which are incorporated herein by reference.

BACKGROUND OF THE INVENTION

1. Field of the Invention

The present invention relates to a cleaning liquid, and an anticorrosive agent for copper or a copper-containing metal.

2. Related Art

Semiconductor devices are formed by laminating a metal wiring layer, a low dielectric layer, an insulating layer or the like on a substrate such as a silicon wafer, and such semiconductor devices are manufactured via processing of each of these layers by a lithography method including carrying out an etching treatment using a resist pattern as a mask.

Residual matter derived from a resist film and a temporarily laminated film (may be also referred to as "sacrificial film") used in the lithography method, as well as the metal wiring layer and the low dielectric layer generated in an etching step are eliminated using a cleaning liquid so as not to be a hindrance for the semiconductor device, and not to obstruct the following step(s).

Furthermore, in recent years, methods of forming wiring have been adopted in which a damascene method is used, in accordance with increased density and enhanced integration of semiconductor devices. According to such a method of forming wiring, copper, a copper-containing metal or the like that is susceptible to corrosion is employed as a metal wiring material that constitutes a metal wiring layer of a semiconductor device.

In the manufacturing methods of these semiconductor devices, an alkaline, acidic or neutral cleaning liquid is used according to the type of the residual matter to be eliminated, whereby corrosion of copper and copper-containing metals is a problem that results from the cleaning liquid. The problem of corrosion of the copper and copper-containing metals is remarkable in the case in which an acidic or alkaline cleaning liquid is used. Therefore, development of a cleaning liquid that prevents these copper and copper-containing metals, etc., from corrosion when cleaning a substrate has been demanded.

In order to solve the problem of corrosion of copper and copper-containing metals, etc., resulting from such a cleaning liquid, a cleaning liquid was proposed which contains as an anticorrosive agent, for example, an alcohol having no less than 2 carbon atoms in which at least one mercapto group is included in the molecule, and a mercapto group and a hydroxyl group are bound to adjacent carbon atoms (see Patent Document 1).

[Patent Document 1] Japanese Unexamined Patent Application, Publication No. 2000-273663

SUMMARY OF THE INVENTION

However, although an effect of preventing corrosion can be found on metals such as copper to some extent according to the cleaning liquid containing an anticorrosive agent described in Patent Document 1, further improvement of the effect of preventing corrosion has been desired.

An object of the present invention is to provide a cleaning liquid, and an anticorrosive agent having a superior anticorrosive effect on copper or a copper-containing metal.

The present inventors thoroughly investigated in order to achieve the object described above, and consequently found that a mercapto compound having a specific structure has a superior anticorrosive effect, and is thus useful as an anticorrosive agent. In addition, the present inventors found that the foregoing problems can be solved by adding the mercapto compound as an anticorrosive agent to a cleaning liquid. Accordingly, the present invention was accomplished. Specifically, the present invention provides the following.

A first aspect of the present invention is a cleaning liquid containing (A) a mercapto compound, and (B) a solvent, in which the mercapto compound (A) is at least one selected from compounds represented by the following formula (1):

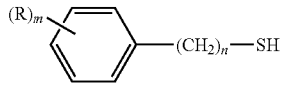

(1)

in the formula (1), R represents a group selected from the group consisting of a hydroxyl group, an alkyl group having 1 to 4 carbon atoms, an alkoxy group having 1 to 4 carbon atoms, an alkylthio group having 1 to 4 carbon atoms, a hydroxyalkyl group having 1 to 4 carbon atoms, a mercaptoalkyl group having 1 to 4 carbon atoms, a halogenated alkyl group having 1 to 4 carbon atoms and a halogen atom; m is an integer of 1 to 3; and n is an integer of 0 to 3, wherein provided that m is 2 or 3, R may be the same or different; and the following formula (2):

$$HS—(CH_2)_x—OH \quad (2)$$

in the formula (2), x is an integer of no less than 3.

A second aspect of the present invention is an anticorrosive agent for copper or a copper-containing metal, consisting of a compound represented by the above formula (1) or formula (2).

According to the present invention, a cleaning liquid, and an anticorrosive agent having a superior anticorrosive effect on copper or a copper-containing metal can be provided.

DETAILED DESCRIPTION OF THE INVENTION

Cleaning Liquid

The cleaning liquid according to the present invention contains (A) a mercapto compound, and (B) a solvent. The mercapto compound (A) is at least one compound selected from an aromatic mercapto compound represented by the formula (1), and a linear mercapto alcohol compound represented by the formula (2) described below.

(A) Mercapto Compound

The cleaning liquid is used for cleaning an object to be cleaned such as, for example, substrates and the like having a wiring formed thereon with copper, a copper-containing metal or the like. By thus cleaning, residual matter and the like attached to the surface of the object to be cleaned, derived from a resist film and a temporarily laminated film, and from the metal wiring layer and the low dielectric layer generated in an etching step are eliminated from the surface of the object to be cleaned. In the case in which the cleaning liquid contains as the mercapto compound (A), one or more compounds selected from a compound represented by the following formula (1), and a linear mercapto alcohol compound represented by the following formula (2), corrosion of wiring consisting of copper or a copper-containing metal can be inhibited, thereby enabling the suppression of changes in a value of resistance during cleaning, and occurrences of breaking of the wire.

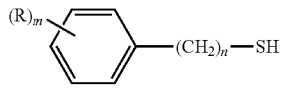

(1)

In the formula (1), R represents a group selected from the group consisting of a hydroxyl group, an alkyl group having 1 to 4 carbon atoms, an alkoxy group having 1 to 4 carbon atoms, an alkylthio group having 1 to 4 carbon atoms, a hydroxyalkyl group having 1 to 4 carbon atoms, a mercaptoalkyl group having 1 to 4 carbon atoms, a halogenated alkyl group having 1 to 4 carbon atoms and a halogen atom; m is an integer of 1 to 3; and n is an integer of 0 to 3, wherein provided that m is 2 or 3, R may be the same or different.

$$HS—(CH_2)_x—OH \quad (2)$$

In the formula (1), x is an integer of no less than 3.

Specific examples of the case in which R represents an alkyl group having 1 to 4 carbon atoms which may have a hydroxyl group in the formula (1) include a methyl group, an ethyl group, a n-propyl group, an iso-propyl group, a n-butyl group, an iso-butyl group, a sec-butyl group, and a tert-butyl group. Among these alkyl groups, a methyl group, a hydroxymethyl group or an ethyl group is preferred since suitable solubility in a solvent can be attained, and a methyl group or a hydroxymethyl group is more preferred since the anticorrosive effect is further improved.

Specific examples of the case in which R represents an alkoxy group having 1 to 4 carbon atoms in the formula (1) include a methoxy group, an ethoxy group, a n-propyloxy group, an iso-propyloxy group, a n-butyloxy group, an iso-butyloxy group, a sec-butyloxy group, and a tert-butyloxy group. Among these alkoxy groups, a methoxy group or an ethoxy group is preferred since suitable solubility in a solvent can be attained, and a methoxy group is more preferred since the anticorrosive effect is further improved.

Specific examples of the case in which R represents an alkylthio group having 1 to 4 carbon atoms in the formula (1) include a methylthio group, an ethylthio group, a n-propylthio group, an iso-propylthio group, a n-butylthio group, an iso-butylthio group, a sec-butylthio group, and a tert-butylthio group. Among these alkylthio groups, a methylthio group or an ethylthio group is preferred since suitable solubility in a solvent can be attained, and a methylthio group is more preferred since the anticorrosive effect is further improved.

Specific examples of the case in which R represents a hydroxyalkyl group having 1 to 4 carbon atoms in the formula (1) include a hydroxymethyl group, a 2-hydroxyethyl group, a 1-hydroxyethyl group, a 3-hydroxy-n-propyl group, a 4-hydroxy-n-butyl group, and the like. Among these hydroxyalkyl groups, a hydroxymethyl group, a 2-hydroxyethyl group or a 1-hydroxyethyl group is preferred since suitable solubility in a solvent can be attained, and a hydroxymethyl group is more preferred since the anticorrosive effect is further improved.

Specific examples of the case in which R represents a mercaptoalkyl group having 1 to 4 carbon atoms in the formula (1) include a mercaptomethyl group, a 2-mercaptoethyl group, a 1-mercaptoethyl group, a 3-mercapto-n-propyl group, a 4-mercapto-n-butyl group, and the like. Among these mercaptoalkyl groups, a mercaptomethyl group, a 2-mercaptoethyl group or a 1-mercaptoethyl group is preferred since suitable solubility in a solvent can be attained, and a mercaptomethyl group is more preferred since the anticorrosive effect is further improved.

In the case in which R represents a halogenated alkyl group having 1 to 4 carbon atoms in the formula (1), examples of the halogen atom included in the halogenated alkyl group include fluorine, chlorine, bromine, iodine, and the like. Specific examples of the case in which R represents a halogenated alkyl group having 1 to 4 carbon atoms include a chloromethyl group, a bromomethyl group, an iodomethyl group, a fluoromethyl group, a dichloromethyl group, a dibromomethyl group, a difluoromethyl group, a trichloromethyl group, a tribromomethyl group, a trifluoromethyl group, a 2-chloroethyl group, a 2-bromoethyl group, a 2-fluoroethyl group, a 1,2-dichloroethyl group, a 2,2-difluoroethyl group, a 1-chloro-2-fluoroethyl group, a 3-chloro-n-propyl group, a 3-bromo-n-propyl group, a 3-fluoro-n-propyl group, a 4-chloro-n-butyl group, and the like. Among these halogenated alkyl groups, a chloromethyl group, a bromomethyl group, an iodomethyl group, a fluoromethyl group, a dichloromethyl group, a dibromomethyl group, a difluoromethyl group, a trichloromethyl group, a tribromomethyl group or a trifluoromethyl group is preferred, and a chloromethyl group, a dichloromethyl group, a trichloromethyl group or a trifluoromethyl group is more preferred since the anticorrosive effect is further improved.

In the case in which R represents a halogen atom in the formula (1), specific examples of the halogen atom include fluorine, chlorine, bromine, and iodine.

In the formula (1), m is an integer of 1 to 3, and more preferably 1. Provided that m is 2 or 3, R may be the same or different.

In the compound represented by the formula (1), the position of substitution with R on the benzene ring is not particularly limited. Since a superior anticorrosive effect is likely to be achieved, the position of substitution with R on the benzene ring is preferably a meta- or para-position with respect to the position at which —(CHd$_n$—SH binds.

As the compound represented by the formula (1), due to superior anticorrosive properties for copper or a copper-containing metal, and superior stability in the cleaning liquid, a compound having at least one group selected from the group consisting of an alkyl group, a hydroxyalkyl group and a mercaptoalkyl group as R is preferred, and a compound having one group selected from the group consisting of an alkyl group, a hydroxyalkyl group and a mercaptoalkyl group as R is more preferred. In the case in which the compound represented by the formula (1) has one group selected from the group consisting of an alkyl group, a hydroxyalkyl group and a mercaptoalkyl group as R, the position of substitution with an alkyl group, a hydroxyalkyl group, or a mercaptoalkyl group on the benzene ring is preferably a meta- or para-position and more preferably a para-position with respect to the position at which —(CHd$_n$—SH binds.

In the formula (1), n is an integer of 0 to 3. Due to ease in preparation and availability of the compound n is preferably 0 or 1, and more preferably 0.

Specific examples of the compound represented by the formula (1) include p-mercaptophenol, p-thiocresol, m-thiocresol, 4-(methylthio)benzenethiol, 4-methoxybenzenethiol, 3-methoxybenzenethiol, 4-ethoxybenzenethiol, 4-isopropyloxy benzenethiol, 4-tert-butoxybenzenethiol, 3,4-dimethoxy benzenethiol, 3,4,5-trimethoxybenzenethiol, 4-ethylbenzenethiol, 4-isopropyl benzenethiol, 4-n-butylbenzenethiol, 4-tert-butylbenzenethiol, 3-ethylbenzenethiol, 3-isopropyl benzenethiol, 3-n-butylbenzenethiol, 3-tert-butylbenzenethiol, 3,5-dimethyl benzenethiol, 3,4-dimethyl benzenethiol, 3-tert-butyl-4-methylbenzenethiol, 3-tert-4-methylbenzenethiol, 3-tert-butyl-5-methylbenzenethiol, 4-tert-butyl-3-methylbenzenethiol, 4-mercaptobenzyl alcohol, 3-mercaptobenzyl alcohol, 4-(mercaptomethyl)phenol, 3-(mercaptomethyl)phenol, 4-fluorobenzenethiol, 3-fluorobenzenethiol, 4-chlorobenzenethiol, 3-chlorobenzenethiol, 4-bromobenzenethiol, 4-iodobenzenethiol, 3-bromobenzenethiol, 3,4-dichlorobenzenethiol, 3,5-dichlorobenzenethiol, 3,4-difluorobenzenethiol, 3,5-difluorobenzenethiol, 4-mercaptocatechol, 2,6-di-tert-butyl-4-mercaptophenol, 3,5-di-tert-butyl-4-methoxybenzenethiol, 4-bromo-3-methylbenzenethiol, 4-(trifluoromethyl)benzenethiol, 3-(trifluoromethyl)benzenethiol, 3,5-bis(trifluoromethyl)benzenethiol, 4-methylthiobenzenethiol, 4-ethylthiobenzenethiol, 4-n-butylthiobenzenethiol, and 4-tert-butylthiobenzenethiol, and the like. Among these compounds, due to high anticorrosive effects on copper and copper-containing metals, and favorable availability, p-mercaptophenol, p-thiocresol, m-thiocresol, 4-(methylthio)benzenethiol, 4-methoxybenzenethiol, 4-ethylbenzenethiol, 4-isopropyl benzenethiol, 4-fluorobenzenethiol, 4-chlorobenzenethiol, and 4-bromobenzenethiol are more preferred. In addition, due to high anticorrosive effects on copper and copper-containing metals, and superior stability in the cleaning liquid, 4-mercaptobenzyl alcohol and 4-(mercaptomethyl) phenol are also preferred.

In the formula (2), x is an integer of no less than 3, and the upper limit thereof is not particularly limited within the range not resulting in impairment of the object of the present invention. In light of the ability to favorably inhibit corrosion of copper and copper-containing metals resulting from the cleaning liquid, x is preferably an integer of no less than 3 and no greater than 10, and more preferably an integer of no less than 3 and no greater than 9. When the compound in which x falls within such a range is used as an anticorrosive agent, the anticorrosive agent is likely to be dissolved in the cleaning liquid, whereby a favorable anticorrosive effect can be readily achieved. Also, in this case, when the object to be cleaned after cleaning is rinsed with water, deposition of the compound represented by the formula (2) as an anticorrosive agent can be suppressed.

Although the compound in which x is an integer of less than 3 is readily dissolved in the cleaning liquid, it exhibits an inferior anticorrosive effect. Although the compound in which x is greater than 10 exhibits a favorable anticorrosive effect, when a cleaning liquid containing such a compound is used, rinsing with water after cleaning may cause deposition on the surface of the object to be cleaned. Therefore, when a cleaning liquid containing the compound in which x is an integer of greater than 10 is used, the cleaning is preferably followed by rinsing with an organic solvent, and then rinsing with water as needed.

Suitable examples of the compound represented by the formula (2) include:

$HS—(CH_2)_3—OH$;
$HS—(CH_2)_4—OH$;
$HS—(CH_2)_5—OH$;
$HS—(CH_2)_6—OH$;
$HS—(CH_2)_7—OH$;
$HS—(CH_2)_8—OH$;
$HS—(CH_2)_9—OH$; and
$HS—(CH_2)_{10}—OH$.

The content of the mercapto compound (A) in the cleaning liquid is not particularly limited as long as it does not inhibit the cleaning effect of the cleaning liquid, and the mercapto compound (A) can be homogenously dissolved in the cleaning liquid. The content of the mercapto compound (A) in the cleaning liquid is preferably 0.05 to 5.0% by mass, and more preferably 0.1 to 1.0% by mass with respect to the mass of the cleaning liquid. When the mercapto compound (A) is added to the cleaning liquid in an amount falling within such a range, in the case in which the object to be cleaned after cleaning with the cleaning liquid is rinsed with water or the like, deposition of the mercapto compound (A) is readily suppressed, while achieving favorable anticorrosive effects of metals. It is to be noted that two or more types of the mercapto compound (A) may be used in combination in the cleaning liquid.

(B) Solvent

The cleaning liquid contains (B) a solvent that dissolves the mercapto compound (A), and (C) an alkaline compound or acidic compound as well as (D) other additives described later. The solvent is not particularly limited as long as it can homogenously dissolve the components contained in the cleaning liquid, and any one of water, an organic solvent, and an aqueous solution of an organic solvent may be used.

Although the organic solvent may be either a water soluble organic solvent or a hydrophobic organic solvent, a water soluble organic solvent is preferred. The organic solvent included in the solvent is preferably water soluble, since the cleaning liquid remaining on the surface of the object to be cleaned can be easily eliminated by rinsing the object to be cleaned with water.

Suitable examples of the water soluble organic solvent include sulfoxides such as dimethyl sulfoxide; sulfones such as dimethyl sulfone, diethyl sulfone, bis(2-hydroxyethyl)sulfone, and tetramethylene sulfone; amides such as N,N-dimethyl formamide, N-methylformamide, N,N-dimethylacetamide, N-methylacetamide, and N,N-diethyl acetamide; lactams such as N-methyl-2-pyrrolidone, N-ethyl-2-pyrrolidone, N-hydroxymethyl-2-pyrrolidone, and N-hydroxyethyl-2-pyrrolidone; lactones such as β-propiolactone, γ-butyrolactone, γ-valerolactone, δ-valerolactone, γ-caprolactone, and ∈-caprolactone; imidazolidinones such as 1,3-dimethyl-2-imidazolidinone, 1,3-diethyl-2-imidazolidinone, and 1,3-diisopropyl-2-imidazolidinone; polyhydric alcohols and derivatives thereof such as ethylene glycol, ethylene glycol monomethyl ether, ethylene glycol monoethyl ether, ethylene glycol monobutyl ether, ethylene glycol monoacetate, ethylene glycol monomethyl ether acetate, ethylene glycol monoethyl ether acetate, diethylene glycol, diethylene glycol monoacetate, diethylene glycol monomethyl ether, diethylene glycol monoethyl ether, diethylene glycol monobutyl ether, propylene glycol, propylene glycol monomethyl ether, propylene glycol monoethyl ether, propylene glycol monopropyl ether, dipropylene glycol monomethyl ether, glycerin, 1,2-butylene glycol, 1,3-butylene glycol, and 2,3-butylene glycol; alkanolamines such as monoethanolamine, diethanolamine, triethanolamine, 2-(2-aminoethoxy)ethanol, N,N-dimethyl ethanolamine, N,N-diethyl ethanolamine, N,N-dibutylethanolamine, N-methylethanolamine, N-ethylethanolamine, N-butylethanolamine, N-methyldiethanolamine, monoisopropanolamine, diisopropanolamine, and triisopropanolamine.

Among these water soluble organic solvents, dimethyl sulfoxide, propylene glycol monomethyl ether, propylene glycol monoethyl ether, propylene glycol monopropyl ether, diethylene glycol monoethyl ether, and diethylene glycol monobutyl ether are more preferred.

When the solvent contained in the cleaning liquid includes a water soluble organic solvent, both hydrophilic residues and hydrophobic residues attached to the object to be cleaned can be easily eliminated. Therefore, it is preferred to use a water soluble organic solvent in combination with water.

The content of the solvent in the cleaning liquid is determined as a matter of course, depending on the used amount of the components dissolved in the cleaning liquid. When the solvent contained in the cleaning liquid includes water and a water soluble organic solvent, the content of the water soluble organic solvent in the cleaning liquid is preferably 10 to 90% by mass, and more preferably 20 to 80% by mass. In the case in which the cleaning liquid does not contain water, the content of the aqueous organic solvent in the cleaning liquid is preferably 50 to 99% by mass, and more preferably 75 to 95% by mass.

(C) Alkaline Compound, or Acidic Compound

As the cleaning liquid, any of an alkaline cleaning liquid, an acidic cleaning liquid, and a neutral cleaning liquid may be used, which may be appropriately selected according to the type of the residual matter to be eliminated attached to the object to be cleaned. Of these cleaning liquids, an alkaline, or acidic cleaning liquid is preferred due to having a superior cleaning effect. When the cleaning liquid is an alkaline, or acidic cleaning liquid, an alkaline compound, or an acidic compound is blended into the cleaning liquid. However, with respect to the alkaline cleaning liquid, it is not always necessary to blend an alkaline compound into the cleaning liquid when the solvent contains an alkanolamine that is a basic compound.

When the cleaning liquid is alkaline, the alkaline compound blended into the cleaning liquid is appropriately selected from an organic or an inorganic alkaline compound. As the organic alkaline compound, a variety of basic nitrogen-containing organic compounds may be used. Among the basic nitrogen-containing organic compounds, a quaternary ammonium hydroxide is preferred. Suitable examples of a quaternary ammonium hydroxide include tetramethylammonium hydroxide, tetraethylammonium hydroxide, tetrapropylammonium hydroxide, tetrabutylammonium hydroxide, ethyltrimethylammonium hydroxide, dimethyl diethylammonium hydroxide, methyltriethylammonium hydroxide, methyltripropylammonium hydroxide, methyltributylammonium hydroxide, benzyltrimethylammonium hydroxide, and (2-hydroxyethyl) trimethylammonium hydroxide, and the like. Among these quaternary ammonium hydroxides, since a favorable cleaning effect of the cleaning liquid can be achieved, tetramethylammonium hydroxide, tetrapropylammonium hydroxide, tetrabutylammonium hydroxide, benzyltrimethylammonium hydroxide and tetraethylammonium hydroxide are preferred, and tetramethylammonium hydroxide or tetrabutylammonium hydroxide is more preferred. The organic alkaline compounds may be used in combination of two or more thereof.

The amount of the organic alkaline compound blended into the cleaning liquid may vary depending on the basicity of the compound, and typically, the amount is preferably 1 to 20% by mass, and more preferably 2 to 15% by mass with respect to the mass of the cleaning liquid.

The inorganic alkaline compound is not particularly limited within the range that does not hamper the object of the present invention, and a variety of compounds may be used. Suitable examples of the inorganic alkaline compound include alkali metal hydroxides such as sodium hydroxide, potassium hydroxide, and rubidium hydroxide. The inorganic alkaline compounds may be used in combination of two or more thereof.

The amount of the inorganic alkaline compound blended into the cleaning liquid may vary depending on the basicity of the compound, and typically, the amount is preferably 0.1 ppm by mass to 1% by mass, and more preferably 1 ppm by mass to 0.5% by mass with respect to the mass of the cleaning liquid.

When the cleaning liquid is acidic, the acidic compound blended into the cleaning liquid is appropriately selected from among protonic acids within the range that does not hamper the object of the present invention. Specific examples of a suitable acidic compound include protonic acids such as hydrochloric acid, hydrofluoric acid, sulfuric acid, nitric acid, formic acid, acetic acid, propionic acid, butyric acid, isobutyric acid, valeric acid, isovaleric acid, lactic acid, oxalic acid, malonic acid, succinic acid, glutaric acid, adipic acid, citric acid, glycolic acid, diglycolic acid, phosphoric acid, methanesulfonic acid, trifluoroacetic acid, and trifluoromethane sulfonic acid. The acidic compound may be used in combination of two or more thereof.

The amount of the acidic compound blended into the cleaning liquid may vary depending on the acidity of the compound, and typically, the amount is preferably 0.1 to 20% by mass, more preferably 0.5 to 15% by mass with respect to the mass of the cleaning liquid. 1.0 to 10% by mass is still more preferable.

(D) Other Additives

The cleaning liquid may contain in addition to the mercapto compound (A), and the alkaline or acidic compound, a variety of additives that may be commonly blended into cleaning liquids, within a range which does not hamper the object of the present invention. Suitable examples of other additives which may be blended into the cleaning liquid include surfactants, antioxidants, antiseptic agents, and the like.

The amount of the other additive used may be appropriately determined according to the type of the additive. The other additive is blended into the cleaning liquid in an amount falling within the range commonly used in cleaning liquids.

Cleaning Method of the Object to be Cleaned

The object to be cleaned which is cleaned by the cleaning liquid containing the mercapto compound (A) is not particularly limited. When the object to be cleaned is a substrate having a metal layer consisting of copper or a copper-containing alloy, corrosion of the metal layer can be favorably inhibited even in the case in which the substrate is cleaned with a cleaning liquid containing the mercapto compound (A). As suitable examples of preferable substrate having a metal layer consisting of copper or a copper-containing alloy, substrates produced by laminating a metal wiring layer, a low dielectric layer, an insulating layer, etc., on a substrate such as a silicon wafer to form a semiconductor device are preferable.

The cleaning method of the object to be cleaned is not particularly limited as long as it is a commonly employed method. Specifically, the cleaning liquid is brought into contact with the object to be cleaned for 1 to 40 min to carry out the treatment using, for example, an immersion method, a puddling method, a showering method or the like. The cleaning is usually carried out at room temperature; however, the temperature of the cleaning liquid may be elevated to about 85° C. in order to improve the cleaning effect.

EXAMPLES

Hereinafter, the present invention will be explained in more detail by way of Examples, but the present invention is not limited to these Examples.

Examples 1 to 10, and Comparative Examples 1 to 4

The compounds shown in Table 2 were used as anticorrosive agents. Each component contained in the cleaning liquid was mixed at each percentage shown in Table 1 below to prepare a homogenously dissolved cleaning liquid. It is to be noted that in Comparative Example 1, the content of water in the cleaning liquid was 50.30% by mass since the anticorrosive agent was not used.

TABLE 1

| | Composition (% by mass) |
|---|---|
| Anticorrosive agent | 0.30 |
| Dimethyl sulfoxide | 25.02 |
| Diethylene glycol monobutyl ether | 16.68 |
| Water | 50.00 |
| Tetramethylammonium hydroxide | 8.00 |

Using the cleaning liquid thus obtained, an anticorrosion test was performed according to the method described below. The amount of corrosion of the copper film (nm) found when the anticorrosion test was performed using each cleaning liquid of the Examples and Comparative Examples is shown in Table 2.

Anticorrosion Test Method

A test piece cut out to give a size of 4 cm×2 cm from a silicon substrate provided with a copper film having a film thickness of 30 nm formed on the surface thereof by a sputtering method was used as an object to be cleaned. As the test vessel, a 100 ml glass beaker was used. The test piece was leaned against the inner wall of the beaker such that the short side of the test piece was in contact with the bottom face of the beaker, and the test was performed. After each cleaning liquid of the Examples, and Comparative Examples which had been warmed to 50° C. was slowly poured into a beaker in which the test piece had been placed, the test piece was immersed in the cleaning liquid for 10 min while the temperature of the cleaning liquid was maintained at 50° C. During the immersion, the cleaning liquid was stirred by a stirring device equipped with a single propeller blade, at a rotation frequency of 200 rpm. After completing the immersion, the test piece was pulled up from the cleaning liquid, the surface of the test piece was rinsed with water, and then, nitrogen was sprayed on the surface of the test piece to dry the test piece. The values of the surface resistance of the surface of the test piece on which the copper film was formed after drying were measured by a VR-70 (manufactured by Kokusai Denki Kabushiki Kaisha). The amount of corrosion of the copper film was calculated from the value of surface resistance.

TABLE 2

| | Anticorrosive agent | Amount of corrosion of the cupper film (nm) |
|---|---|---|
| Example 1 | p-Mercaptophenol | 0.09 |
| Example 2 | p-Thiocresol | 0.22 |
| Example 3 | m-Thiocresol | 0.18 |
| Example 4 | 4-(Methylthio) benzenethiol | 0.21 |
| Example 5 | 4-Methoxybenzenethiol | 0.37 |
| Example 6 | 4-Ethylbenzenethiol | 0.19 |
| Example 7 | 4-Isopropylbenzenethiol | 0.17 |
| Example 8 | 4-Fluorobenzenethiol | 0.22 |
| Example 9 | 4-Chlorobenzenethiol | 0.13 |
| Example 10 | 4-Bromobenzenethiol | 0.04 |
| Comparative example 1 | None | No less than 30.00 |
| Comparative example 2 | Thioglycerol | 1.71 |
| Comparative example 3 | Benzylmercaptan | 1.01 |
| Comparative example 4 | Thiophenol | 2.04 |

According to Examples 1 to 10, and Comparative Example 1, it can be understood that the cleaning liquid containing the aromatic mercapto compound represented by the formula (1) as an anticorrosive agent can extremely favorably inhibit corrosion of copper in the cleaning step. On the other hand, according to Comparative Examples 2 to 4, it can be understood that even in the case of a compound having a mercapto group, the cleaning liquid in which a compound other than that represented by the formula (1) or formula (2) was used as an anticorrosive agent results in corrosion of the copper film to some extent although the corrosion of the copper film is inhibited.

Examples 11 and 12

The cleaning liquid of Example 11 was prepared similarly to Example 2 except that the content of p-thiocresol was changed from 0.30% by mass to 0.10% by mass, and that the content of water was changed from 50.00% by mass to 50.20% by mass. In addition, the cleaning liquid of Example 12 was prepared similarly to Example 2 except that the content of p-thiocresol was changed from 0.30% by mass to 0.70% by mass, and that the content of water was changed from 50.00% by mass to 49.60% by mass.

When the anticorrosion test was performed using the cleaning liquids of Examples 11 and 12 similarly to Example 2, the amount of corrosion of the copper film was 0.35 nm in the case of the cleaning liquid of Example 11, whereas the amount of corrosion of the copper film was 0.15 nm in the case of the cleaning liquid of Example 12.

According to Example 2 and Example 11, it can be understood that when the content of the anticorrosive agent in the cleaning liquid was lowered to about 0.10% by mass, superior anticorrosive effect can be maintained although the amount of corrosion of the copper film somewhat increases. Also, according to Example 2 and Example 12, it can be understood that an increase in the content of the anticorrosive agent in the cleaning liquid enables the anticorrosive effect of the cleaning liquid to be further improved.

Example 13, and Comparative Example 5

The compounds shown in Table 4 were used as anticorrosive agents. Each component contained in the cleaning liquid was mixed at each percentage shown in Table 3 below to prepare a homogeneously dissolved cleaning liquid. It is to be noted that in Comparative Example 5, the content of water in the cleaning liquid was 50.30% by mass since the anticorrosive agent was not used.

TABLE 3

| | Composition (% by mass) |
|---|---|
| Anticorrosive agent | 0.30 |
| Dimethyl sulfoxide | 29.52 |
| Diethylene glycol monobutyl ether | 19.68 |
| Water | 50.00 |
| Potassium hydroxide | 0.5 |

TABLE 4

| | Anticorrosive agent | Amount of corrosion of the cupper film (nm) |
|---|---|---|
| Example 13 | p-thiocresol | 0.21 |
| Comparative example 5 | None | No less than 30.00 |

According to Example 2 and Example 13, and Comparative Example 5, it can be understood that in the alkaline cleaning liquids, irrespective of the type of alkaline substance included in the cleaning liquid, use of the aromatic mercapto compound represented by the formula (1) as an anticorrosive agent enables corrosion of copper to be extremely favorably inhibited in the cleaning step.

Example 14 and Comparative Example 6

The compounds shown in Table 6 were used as anticorrosive agents. Each component contained in the cleaning liquid was mixed at each percentage shown in Table 5 below to prepare a homogeneously dissolved cleaning liquid. It is to be noted that in Comparative Example 6, the content of water in the cleaning liquid was 50.30% by mass since the anticorrosive agent was not used.

TABLE 5

| | Composition (% by mass) |
|---|---|
| Anticorrosive agent | 0.30 |
| Dimethyl sulfoxide | 23.82 |
| Diethylene glycol monobutyl ether | 15.88 |
| Water | 50.00 |
| Malonic acid | 10.00 |

TABLE 6

| | Anticorrosive agent | Amount of corrosion of the cupper film (nm) |
|---|---|---|
| Example 14 | p-thiocresol | 0.50 |
| Comparative example 6 | None | No less than 30.00 |

According to Example 14 and Comparative Example 6, it can be understood that also in acidic cleaning liquids, use of the aromatic mercapto compound represented by the formula (1) as an anticorrosive agent enables corrosion of copper to be extremely favorably inhibited in the cleaning step.

Examples 15 to 17, and Comparative Example 7

The compounds shown in Table 8 were used as anticorrosive agents. Each component contained in the cleaning liquid was mixed at each percentage shown in Table 7 below to prepare a homogeneously dissolved cleaning liquid. It is to be noted that for comparison with Examples 15 to 17, the results of Comparative Examples 1 and 2 are shown together in Table 8.

TABLE 7

| | Composition (% by mass) |
|---|---|
| Anticorrosive agent | 0.30 |
| Dimethyl sulfoxide | 25.02 |
| Diethylene glycol monobutyl ether | 16.68 |
| Water | 50.00 |
| Tetramethylammonium hydroxide | 8.00 |

Using the cleaning liquid thus obtained, an anticorrosion test was performed according to a similar method to Example 1. The amount of corrosion of the copper film (nm) found when the anticorrosion test was performed using each cleaning liquid of the Examples and Comparative Examples is shown in Table 8.

TABLE 8

| | Anticorrosive agent | Amount of corrosion of the cupper film (nm) |
|---|---|---|
| Example 15 | $HS—(HC_2)_3—OH$ | 0.80 |
| Example 16 | $HS—(CH_2)_6—OH$ | 0.72 |
| Example 17 | $HS—(CH_2)_9—OH$ | 0.05 |
| Comparative example 1 | None | No less than 30.00 |
| Comparative example 2 | Thioglycerol | 1.71 |
| Comparative example 7 | Mercaptoethanol | 1.36 |

According to Examples 15 to 17, and Comparative Example 1, it can be understood that the cleaning liquid containing the linear mercapto alcohol compound represented by the formula (2) as an anticorrosive agent can extremely favorably inhibit corrosion of copper in the cleaning step. On the other hand, according to Comparative Examples 2 and 7, it can be understood that even in the case of a compound having a mercapto group, the cleaning liquid in which a compound other than that represented by the formula (1) or formula (2) was used as an anticorrosive agent results in corrosion of the copper film to some extent although the corrosion of the copper film is inhibited.

Examples 18 and 19

The cleaning liquid of Example 18 was prepared similarly to Example 16 except that the content of mercaptohexanol ($HS—(CH_2)_6—OH$) was changed from 0.30% by mass to 0.10% by mass, and that the content of water was changed from 50.00% by mass to 50.20% by mass. In addition, the cleaning liquid of Example 19 was prepared similarly to Example 16 except that the content of mercaptohexanol was changed from 0.30% by mass to 0.70% by mass, and that the content of water was changed from 50.00% by mass to 49.60% by mass.

When the anticorrosion test was performed using the cleaning liquids of Examples 18 and 19 similarly to Example 1, the amount of corrosion of the copper film was 0.85 nm in the case of the cleaning liquid of Example 18, whereas the amount of corrosion of the copper film was 0.50 nm in the case of the cleaning liquid of Example 19.

According to Example 16 and Example 18, it can be understood that when the content of the linear mercapto alcohol compound in the cleaning liquid was lowered to about 0.10% by mass, superior anticorrosive effect can be maintained although the amount of corrosion of the copper film somewhat increases. Also, according to Example 16 and Example 19, it can be understood that an increase in the content of the linear mercapto alcohol compound in the cleaning liquid enables the anticorrosive effect of the cleaning liquid to be further improved.

Example 20

The compound shown in Table 10 was used as an anticorrosive agent. Each component contained in the cleaning liquid was mixed at each percentage shown in Table 9 below to prepare a homogeneously dissolved cleaning liquid. It is to be noted that for comparison, the results of Comparative Example 5 are shown together with those of Example 20 in Table 10.

TABLE 9

| | Composition (% by mass) |
|---|---|
| Anticorrosive agent | 0.30 |
| Dimethyl sulfoxide | 29.52 |
| Diethylene glycol monobutyl ether | 19.68 |
| Water | 50.00 |
| Potassium hydroxide | 0.5 |

TABLE 10

| | Anticorrosive agent | Amount of corrosion of the cupper film (nm) |
|---|---|---|
| Example 20 | HS—$(CH_2)_6$—OH | 0.62 |
| Comparative example 5 | None | No less than 30.00 |

According to Example 16 and Example 20, and Comparative Example 5, it can be understood that in the alkaline cleaning liquids, irrespective of the type of alkaline substance included in the cleaning liquid, use of the linear mercapto alcohol compound represented by the formula (2) as an anticorrosive agent enables corrosion of copper to be extremely favorably inhibited in the cleaning step.

Example 21

The compound shown in Table 12 was used as an anticorrosive agent. Each component contained in the cleaning liquid was mixed at each percentage shown in Table 11 below to prepare a homogeneously dissolved cleaning liquid. It is to be noted that for comparison, the results of Comparative Example 6 are shown together with those of Example 21 in Table 12.

TABLE 11

| | Composition (% by mass) |
|---|---|
| Anticorrosive agent | 0.30 |
| Dimethyl sulfoxide | 23.82 |
| Diethylene glycol monobutyl ether | 15.88 |
| Water | 50.00 |
| Malonic acid | 10.00 |

TABLE 12

| | Anticorrosive agent | Amount of corrosion of the cupper film (nm) |
|---|---|---|
| Example 21 | HS—$(CH_2)_6$—OH | 0.75 |
| Comparative example 6 | None | No less than 30.00 |

According to Example 21 and Comparative Example 6, it can be understood that also in the acidic cleaning liquid, use of the linear mercapto compound represented by the formula (2) as an anticorrosive agent enables corrosion of copper to be extremely favorably inhibited in the cleaning step.

What is claimed is:

1. A method of cleaning a substrate having a metal layer comprising copper or copper-containing alloy, the method comprising cleaning the substrate including a metal layer comprising copper or a copper-containing alloy using a cleaning liquid, wherein the cleaning liquid comprises (A) a mercapto compound, and (B) a solvent, wherein the mercapto compound (A) is at least one selected from the group consisting of compounds represented by the following formula (1):

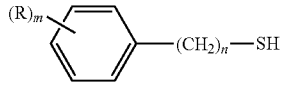

(1)

wherein, R represents a group selected from the group consisting of a hydroxyl group, an ethyl group, an n-propyl group, an iso-propyl group, an n-butyl group, an iso-butyl group, a sec-butyl group, a tert-butyl group, an alkoxy group having 1 to 4 carbon atoms, an alkylthio group having 1 to 4 carbon atoms, a hydroxyalkyl group having 1 to 4 carbon atoms, a mercaptoalkyl group having 1 to 4 carbon atoms, a halogenated alkyl group having 1 to 4 carbon atoms and a halogen atom; m is an integer of 1 to 3; and n is an integer of 0 to 3, wherein provided that m is 2 or 3, R may be the same or different; and selected from the group consisting of HS—$(CH_2)_4$—OH;
HS—$(CH_2)_5$—OH;
HS—$(CH_2)_6$—OH;
HS—$(CH_2)_7$—OH;
HS—$(CH_2)_8$—OH;
HS—$(CH_2)_9$—OH; and
HS—$(CH_2)_{10}$—OH, wherein the solvent (B) contains water and a water-soluble organic solvent.

2. The method according to claim 1, wherein the position of binding of R is a meta- or para-position with respect to the position at which —$(CH_2)_n$—SH binds.

3. The method according to claim 1, wherein R represents a hydroxyl group.

4. The method according to claim 1, wherein R is the compound selected from the group consisting of HS—$(CH_2)_4$—OH,
HS—$(CH_2)_5$—OH,
HS—$(CH_2)_6$—OH,
HS—$(CH_2)_7$—OH,
HS—$(CH_2)_8$—OH,
HS—$(CH_2)_9$—OH, and
HS—$(CH_2)_{10}$—OH.

5. The method according to claim 1, wherein the mercapto compound (A) is at least one selected from the group consisting of compounds represented by the following formulas (1):

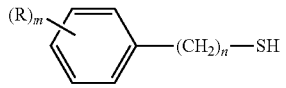

(1)

wherein, R represents a group selected from the group consisting of a hydroxyl group, an ethyl group, an n-propyl group, an iso-propyl group, an n-butyl group, an iso-butyl group, a sec-butyl group, a tert-butyl group, an alkoxy group having 1 to 4 carbon atoms, an alkylthio group having 1 to 4 carbon atoms, a hydroxyalkyl group having 1 to 4 carbon atoms, a mercaptoalkyl group having 1 to 4 carbon atoms, a halogenated alkyl group having 1 to 4 carbon atoms and a halogen atom; m is an integer of 1 to 3; and n is an integer of 0 to 3, wherein provided that m is 2 or 3, R may be the same or different; and

HS—$(CH_2)_9$—OH.

* * * * *